US006758349B1

(12) United States Patent
Kwap et al.

(10) Patent No.: US 6,758,349 B1
(45) Date of Patent: Jul. 6, 2004

(54) TRAY HOLDING DISPLAY SYSTEM

(75) Inventors: John A. Kwap, White Plains, NY (US); Louis R. Csak, Old Greenwich, CT (US); Arthur R. Martin, Westport, CT (US)

(73) Assignee: Mechtronics Corporation, White Plains, NY (US)

( * ) Notice: Subject to any disclaimer, the term of this patent is extended or adjusted under 35 U.S.C. 154(b) by 0 days.

(21) Appl. No.: 10/218,058

(22) Filed: Aug. 12, 2002

Related U.S. Application Data

(60) Provisional application No. 60/386,949, filed on Jun. 7, 2002, provisional application No. 60/360,801, filed on Mar. 1, 2002, and provisional application No. 60/311,679, filed on Aug. 10, 2001.

(51) Int. Cl.[7] ..... A47F 5/00

(52) U.S. Cl. ..... 211/59.2; 211/49.1; 211/135; 312/42

(58) Field of Search ..... 211/72, 49.1, 59.2, 211/135; 206/738, 745; 312/42; 248/174

(56) References Cited

U.S. PATENT DOCUMENTS

| | | | | |
|---|---|---|---|---|
| 653,086 | A | * | 7/1900 | Houts |
| 1,620,808 | A | * | 3/1927 | Eldridge |
| 3,175,729 | A | * | 3/1965 | Tyte |
| 4,373,449 | A | * | 2/1983 | Klaus et al. ..... 248/174 X |
| 4,813,535 | A | * | 3/1989 | Radocha et al. |
| 4,850,511 | A | * | 7/1989 | Kral et al. ..... 312/42 X |
| 5,370,220 | A | * | 12/1994 | Wang ..... 312/42 X |
| 5,839,587 | A | * | 11/1998 | Gress et al. ..... 211/59.2 |
| D418,331 | S | * | 1/2000 | Christescu |
| 6,547,084 | B2 | * | 4/2003 | Bauman et al. |

* cited by examiner

*Primary Examiner*—Robert W. Gibson, Jr.
(74) *Attorney, Agent, or Firm*—Wiggin and Dana LLP; Dale L. Carson; Michael K. Kinney

(57) ABSTRACT

A display system includes a reusable basic unit into which a product-carrying tray may be inserted to display/dispense such product. The trays are replaceable as the product is expended. The basic unit advantageously includes portions for removably accommodating graphics so that, for various promotional events, different graphics can be used for each event.

23 Claims, 14 Drawing Sheets

TRAY HOLDING DISPLAY SYSTEM

CROSS-REFERENCE TO RELATED APPLICATIONS

This application claims priority of Ser. Nos. 60/311,679, 60/360,801, and 60/386,949 respectively filed Aug. 10, 2001, Mar. 1, 2002, and Jun. 7, 2002 and all entitled "Tray Holding Display System," the disclosures of which are incorporated by reference in their entireties herein as if set forth at length.

BACKGROUND OF THE INVENTION (1) Field of the Invention

This invention relates to displays.

(2) Description of the Related Art

Many types of displays are used in the retail environment. In one exemplary display system used in the personal care/over-the-counter drug market, manufacturer uses temporary corrugated displays for merchandising of their promotional product offerings. To initiate a promotional merchandise offer one or more decorated corrugated shelf displays loaded with product are shipped to each participating retail store. Then, for the life of the promotion (e.g., typically 8–16 weeks), an entire new display must be shipped to replace each depleted display. This may entail replacing not only the product but also the highly decorated corrugated display which may well be intact and otherwise functional. For a promotion linking one manufacturer to national chain of, for example, 1000 or more stores, 15,000 displays may be utilized over the life of a single promotion. This entails both a substantial expenditure on the manufacturer's part and can create disposal problems.

BRIEF SUMMARY OF THE INVENTION

In a display system, we have separated product-carrying trays from a remaining more permanent portion of the system so that product can be replenished by removing an expended tray, and replacing it with a full tray. Advantageously, the initial tray or trays may be replaced by identical trays within a single promotion and then graphic portions replaced on the permanent display structure to initiate a subsequent promotion with a subsequent and different initial and series of replacement trays.

Thus in one aspect, a housing has a front end opening for receiving a tray holding a number of products. A signage carrier has an installed position mounted across a portion of the opening in front of an upper portion of the tray. A signage carrying trim member depends from housing so as to be positioned in front of a front edge of the shelf on which the housing is placed. The housing may have left and right sidewalls each having an outboard surface. Each sidewall may have a front portion shaped in elevation as a substantially non-right parallelogram with horizontal bottom and top edges and front-to-back inclined fore and aft edges. Such sidewall may have an aft portion having a substantially vertical aft edge. The signage carrier may have an aperture for exposing a product sample mounted to the tray. The product may be over-the-counter medication.

In another aspect, a tray assembly includes a body formed of folded corrugated material and containing a number of stacks of products. A body bottom wall has front and back edges and left and right edges. A body back wall extends upward from the bottom wall back edge and has bottom and top edges and left and right edges. Body left and right sidewalls extend upward from the bottom wall left and right edges. A body top wall extends between the sidewalls. A number of front-to-back divider walls separate a number of lanes, each lane carrying an associated one of the stacks. The body has an open front area of sufficient extent to provide access to a bottom product in each stack and removal of such bottom product. The dividers may have open areas dimensioned to allow a user to insert one or more fingers between the stacks to grab the bottom products. A retainer may cover the portion of the front of the body above the open front area.

In another aspect, a tray assembly includes a body defining a right parallepiped and a divider carried within the body. The divider has a number of front-to-back divider walls having a separation effective to provide number of lanes. The divider has a spacer wall having a forward surface forwardly offset from a forward surface of the body back wall. The body may consist essentially of a single piece of corrugated boxboard. The spacer may be so offset by between 25% and 75% of a depth of the body. The body open area may extend over the entire front of the parallelpiped above the bottom wall. The body may have a second open area along at least the front portion of a top of the parallelpiped. The secondary open area may extend over at least half of the parallelpiped. The divider may include an assembly of corrugated boxboard pieces. A first divider piece may provide the spacer wall and have left and right side portions folded back at left and right edges of the spacer wall and extending along the rear portions of the left and right sidewalls to maintain the offset of the spacer wall from the back wall. A number of divider pieces may each form one of the divider walls, the divider walls being of two-layer construction over at least the major portion thereof. The divider walls and the first piece left and right portions may each have relieved areas accommodating the body top wall. Each divider wall may have a slot receiving a portion of the spacer wall and the spacer wall may have a number of slots each receiving a portion of an associated one of the divider walls. The tray similarly may include a retainer and a cover. The retainer may have a front wall covering a portion of the body open area above a lower portion of the body open area. The retainer may have left and right sidewalls sandwiched between respective left and right sidewalls of the body and left and right side portions of the divider first piece. The cover may consist essentially of a single piece of corrugated boxboard. The cover may include means for defining a pull tab. The cover may include tabs extending to apertures along fold areas along the front edges of the body sidewalls. The cover may include a portion wedged between the body top and the divider walls. The body may have a single layer along its back wall. The body may have at least two layers along each of its top wall, bottom wall, and left and right sidewalls, with a fold area along the front edge of the top wall, bottom wall and left and right sidewalls. An inner one of two layers of each of the left and right sidewalls may have at least one tab extending into an associated aperture in the back wall.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements. Where shown, exemplary dimensions are in inches.

DETAILED DESCRIPTION

Figure 1:
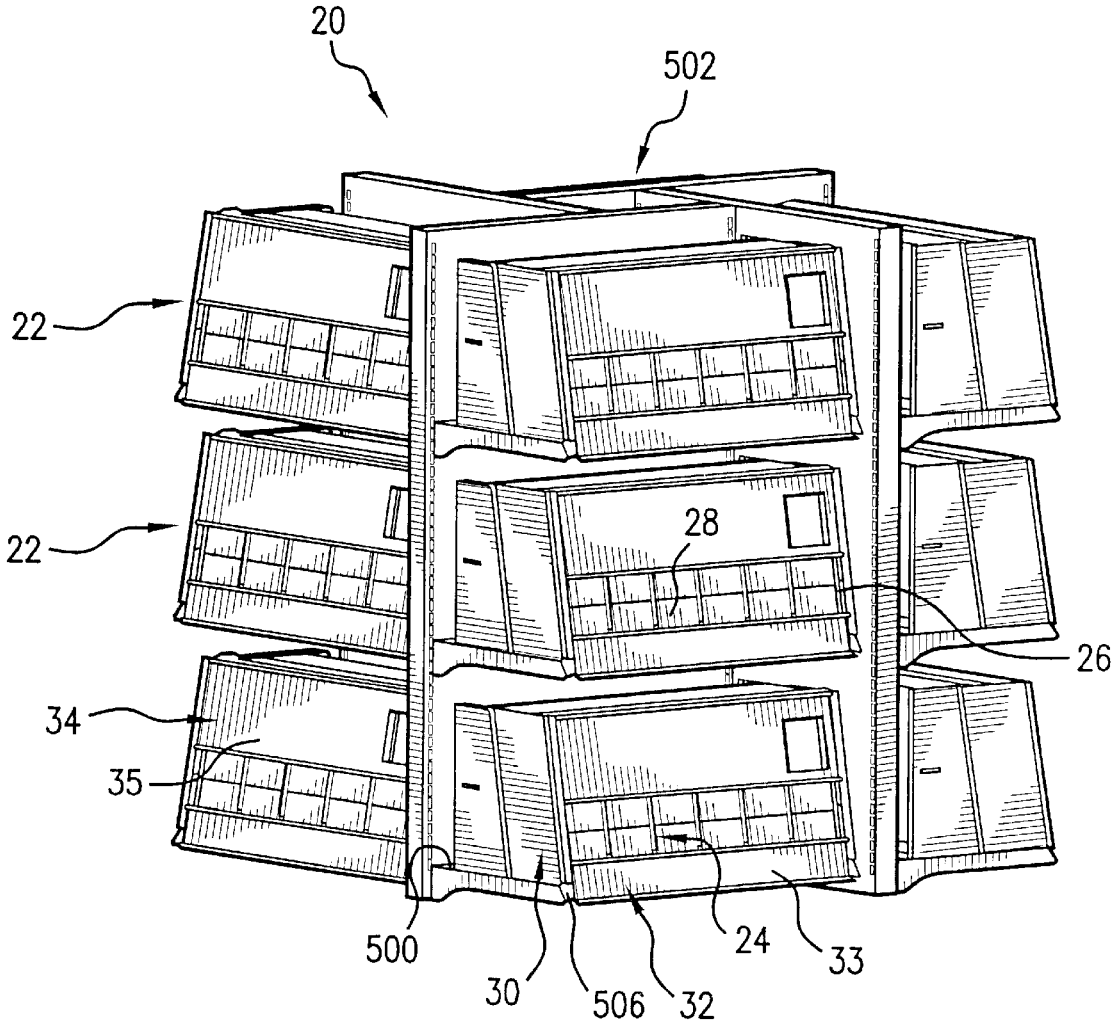
FIG. 1 is a view of an installed display system according to principles of the invention.

FIG. 1 shows a system 20 including a plurality of basic display units or modules 22 stacked one above another on separate shelves 500 of an environmental shelving structure 502. A header (not shown) may be associated with the shelved modules 22 and may bear graphics associated with the products dispensed by the modules 22. Each display module 22 may contain one or more product modules 24 such as a corrugated PDQ tray 26 containing a plurality of stacks of product 28.

In the exemplary embodiment, each display module 22 includes a housing 30 which defines a compartment for containing the associated tray(s) 26. The exemplary display module 22 further includes a trim member 32 depending from the housing 30 so as to be positioned in front of a front edge 506 of the associated shelf 500. The trim member may carry signage (e.g., text and graphics on a card 33, label, or the like). The exemplary display module 22 further includes a signage carrier 34 having an installed position mounted across a portion of a front end opening of the housing and which similarly may carry a card 35 or other signage. In the installed position, the exemplary signage carrier extends across approximately one half of the vertical extent of the opening.

Figure 2:
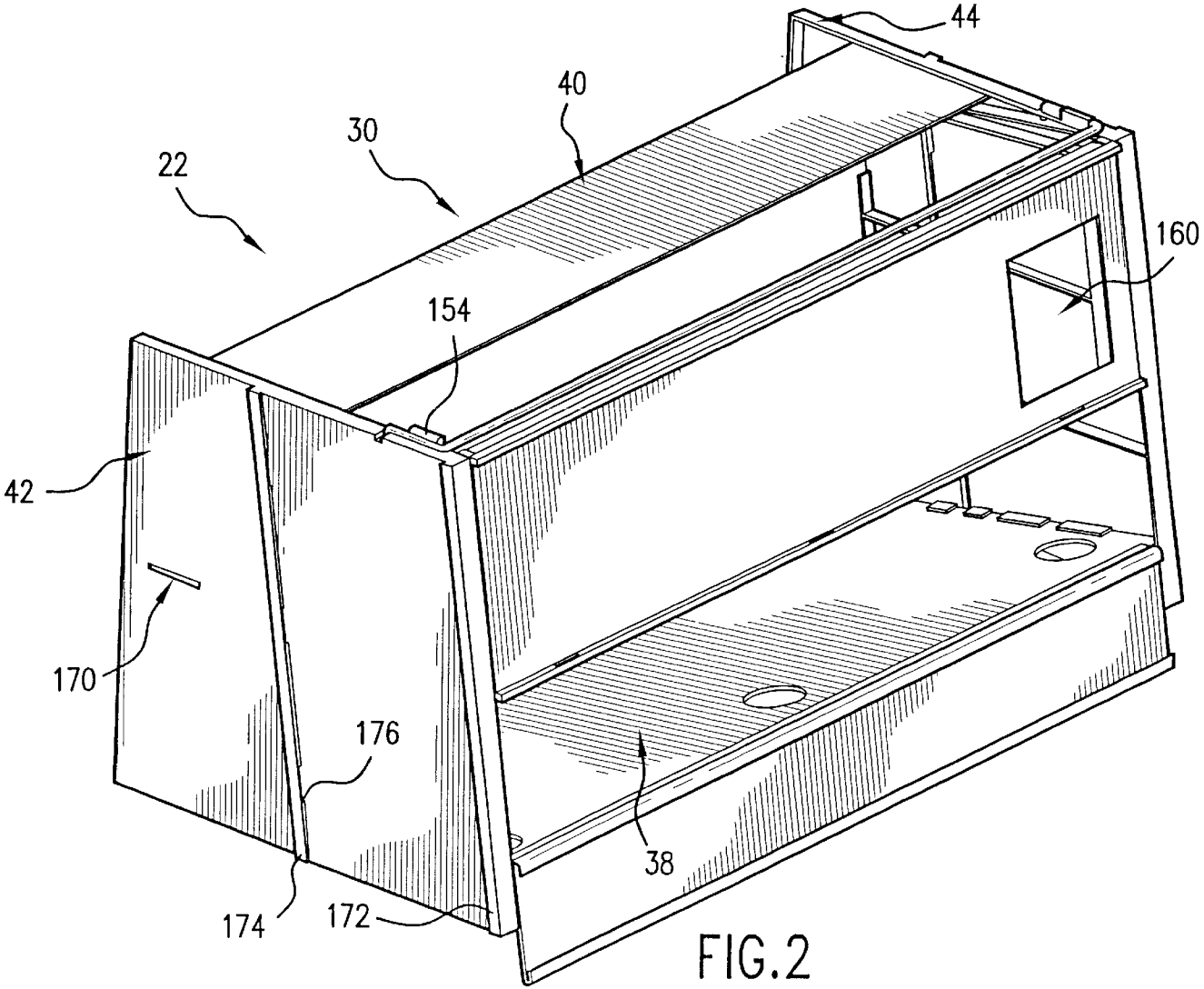
FIG. 2 is a view of an empty display module of the system of FIG. 1 with a deployed signage carrier.

FIG. 2 shows an exemplary empty individual display module 22 with a compartment 37 for receiving the product module. The exemplary housing 30 is an assembly including a first element 40 having portions generally defining a top wall, a back wall, and a floor or bottom wall of the compartment 38. The first element 40 is sandwiched between respective left and right side wall elements 42 and 44 (left and right being viewed from the frame of reference of a user standing in front of and facing the module). The exemplary first element 40 is formed of folded corrugated stock (e.g., B-flute) having four substantially flat wall portions, namely an upper or top portion 50 (FIG. 3) generally bounding a top rear portion of the compartment, a rear or back portion 52 depending from a rear edge of the top portion 50, a lower, bottom, or floor portion 54 extending forward from a lower edge of the back portion 52, and a front lip portion 56 depending from a front edge of the floor portion at nearly a right angle thereto. Each exemplary side wall 42 and 44 (e.g., injection molded of ABS) has inner and outer surfaces 45 and 46 with a plurality of bosses 60 in the inner surfaces 45 (FIG. 4) for gripping left and right edge portions of the various wall portions 50, 52, 54, and 56 and maintaining them in a given orientation. In the exemplary configuration, the upper portion 50 is parallel to the upper surface of the shelf 500, the back portion 52 is rearwardly inclined from bottom to top at an exemplary angle θ off vertical of 5–30°. In the exemplary configuration, the floor portion 54 is substantially perpendicular to the back portion 52 and, thereby, is inclined at the angle θ from front to back. The lip 56 is substantially perpendicular to the floor 54 as are the front edges 62 of the side walls. The top and bottom edges 63 and 64 of the side walls are parallel to the upper shelf surface 504, with the latter there atop.

The exemplary trim member 32 is held with its front surface 70 substantially parallel to a the lip 56. The exemplary trim member is formed as an extrusion (e.g., of a styrene/Krayton™ TPE coextrusion) having a cross-section characterized by a front flange 72, the forward portion of which defines the surface 70 and the upper and lower edges of which curve back in front of the surface 70 to define respective downwardly and upwardly open U-shaped channel portions 74 and 76, respectively. A top plate portion 80 extends rearward from the upper edge of the flange 72. In the exemplary embodiment, a forward portion 81 of the top plate 80 is formed from a relatively flexible material (e.g., TPE), whereas the remainder of the trim member is formed of a more rigid material (e.g., styrene). The portion 81 may thus provide a flexible hinge, allowing the front flange to pivot relative to the portion aft thereof. The hinge may allow more efficient packaging for shipping, and also may adapt the trim member to different shelf front forms and relative positions. The top plate 80 ends at a long, narrow, upwardly open U-sectioned channel 82 capturing the lip 56 and is secured thereto via a plurality of fasteners 88 (e.g., plastic rivets) extending through the lip 56 both walls of the channel 82. A rear wall 90 extends aft and downward from an intermediate location on the rear portion of the channel 82 and, at its lower end, meets a rearwardly directed flange 92. The flange is positioned substantially coplanar with bottom edges 64 of the side walls 42 and 44 and back portion 52 and is secured atop the shelf via fasteners 96 (e.g., viking clip screw & wing nut fasteners).

The signage carrier 34 is advantageously movable from its installed or deployed position to a removed position or a stowed position wherein it does not substantially obstruct the housing opening so as to permit installation of fresh product modules into the housing compartment and removal of spent trays from the housing compartment. In the exemplary embodiment, the signage carrier is guided between the deployed position (FIG. 2) and a stowed position (FIGS. 4 and 5) extending along a forward portion of the top of the compartment. A primary portion of the signage carrier is a molded member 100 (FIG. 6) (e.g., of ABS) formed having a central web 102 extending between left and right edges 104 and 106 and having a front surface 108. Reinforcement ribs 109 may protrude from the back surface and may include various vertical, horizontal, diagonal or other portions. At upper and lower ends of the web, the cross-section has upper and lower lips 110 and 112 protruding forward of the front surface 108. The lips 110 and 112 have opposed blind slots 113 for capturing upper and lower tabs of a graphic panel or the like to hold the panel against the surface 108. A top channel portion 114 extends aft from the upper edge of the web portion 102.

Figure 3:
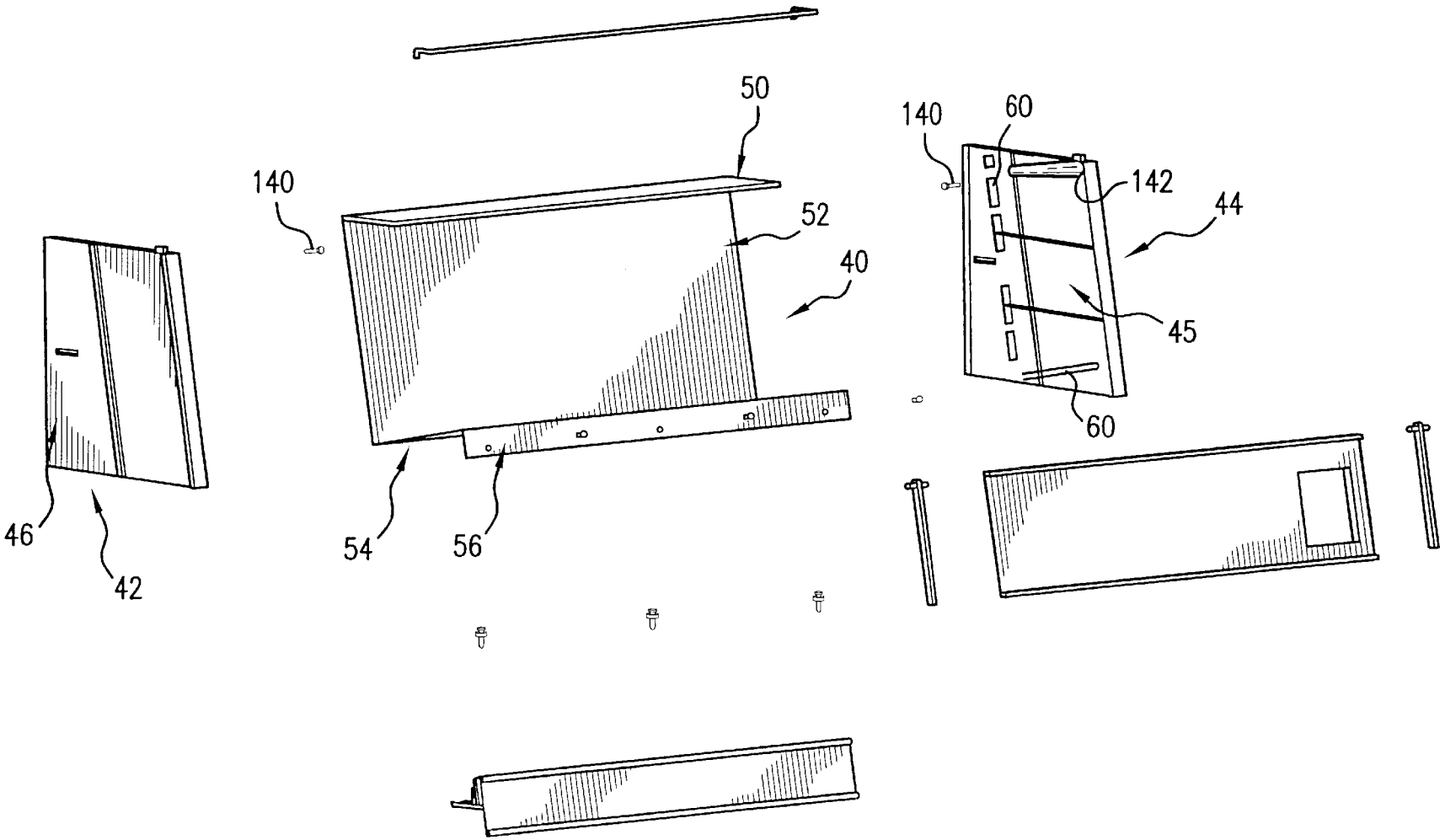
FIG. 3 is an exploded view of the module of FIG. 2.
Figure 4:
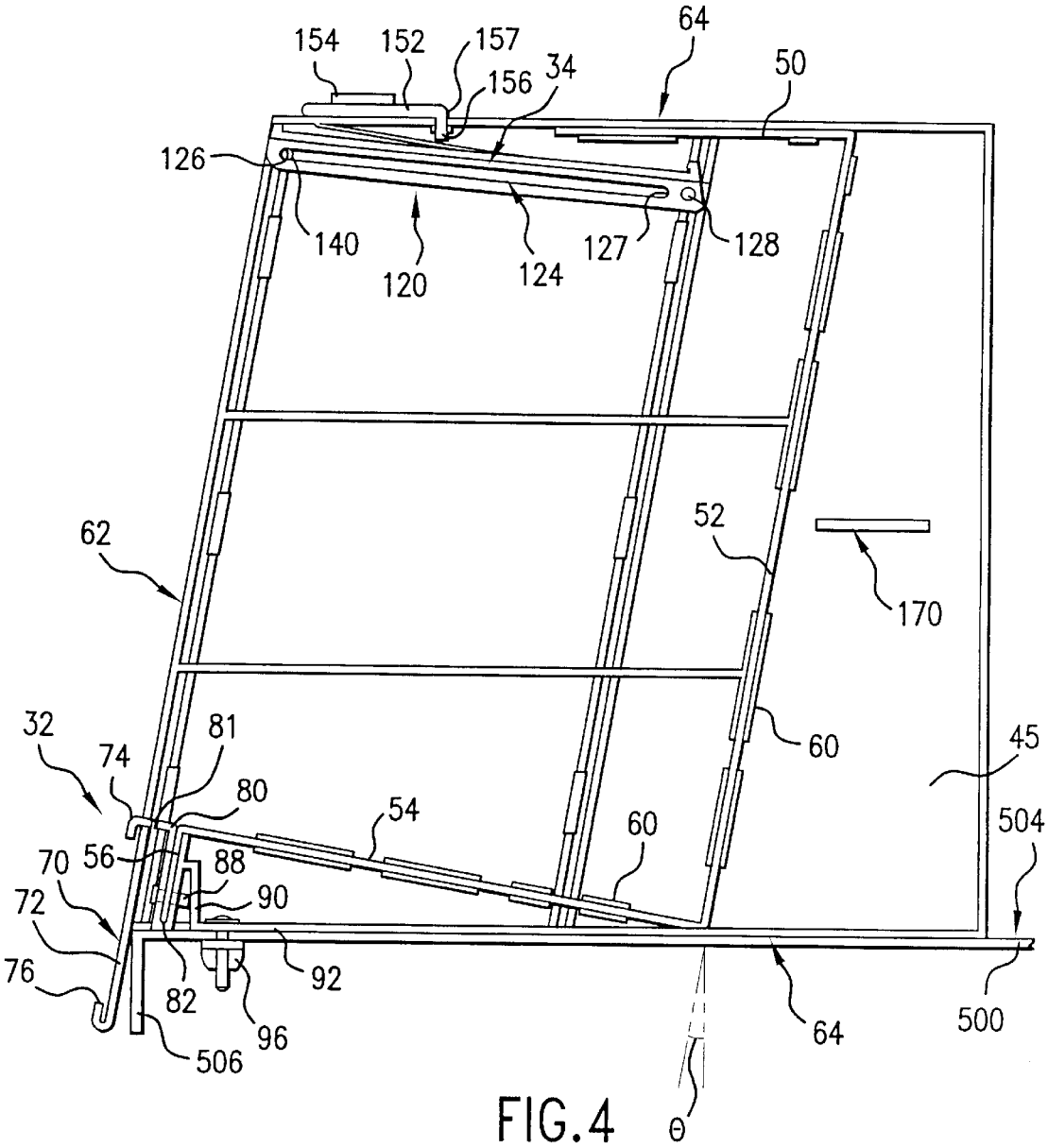
FIG. 4 is a side view of the display module of FIG. 2 with the signage carrier in a retracted position and a right side wall exploded out of view.
Figure 7:
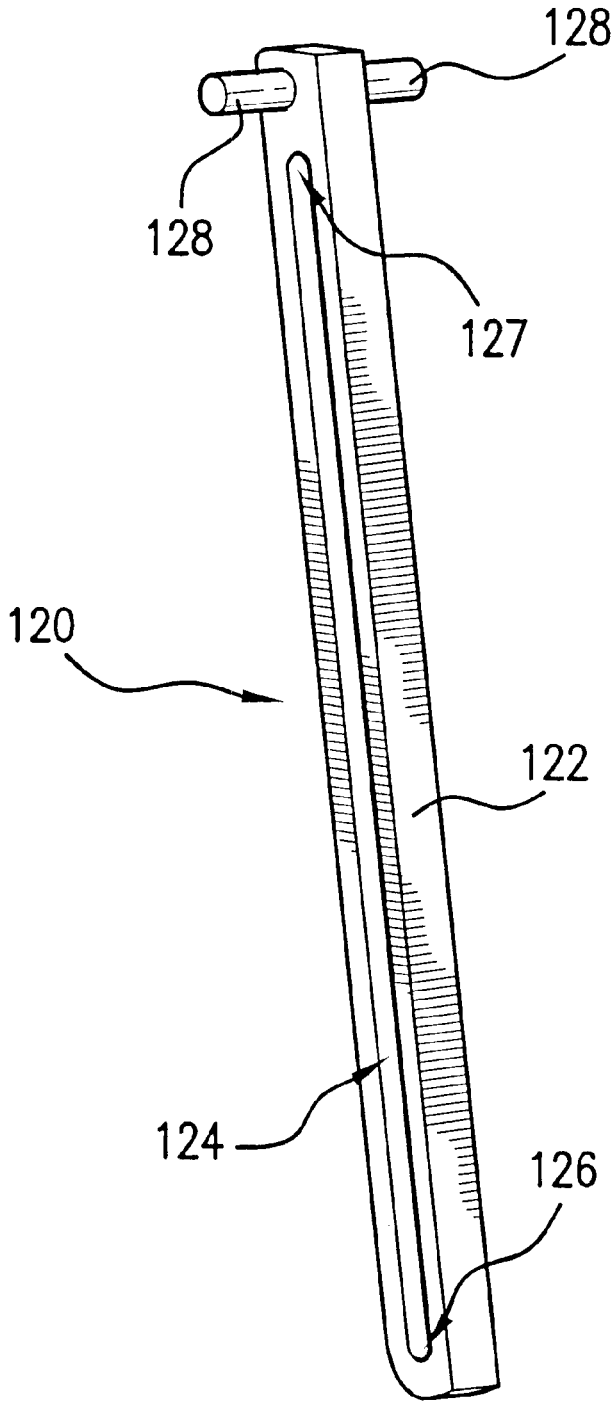
FIG. 7 is a view of a track member of the signage carrier of the module of FIG. 2.
Figure 8:
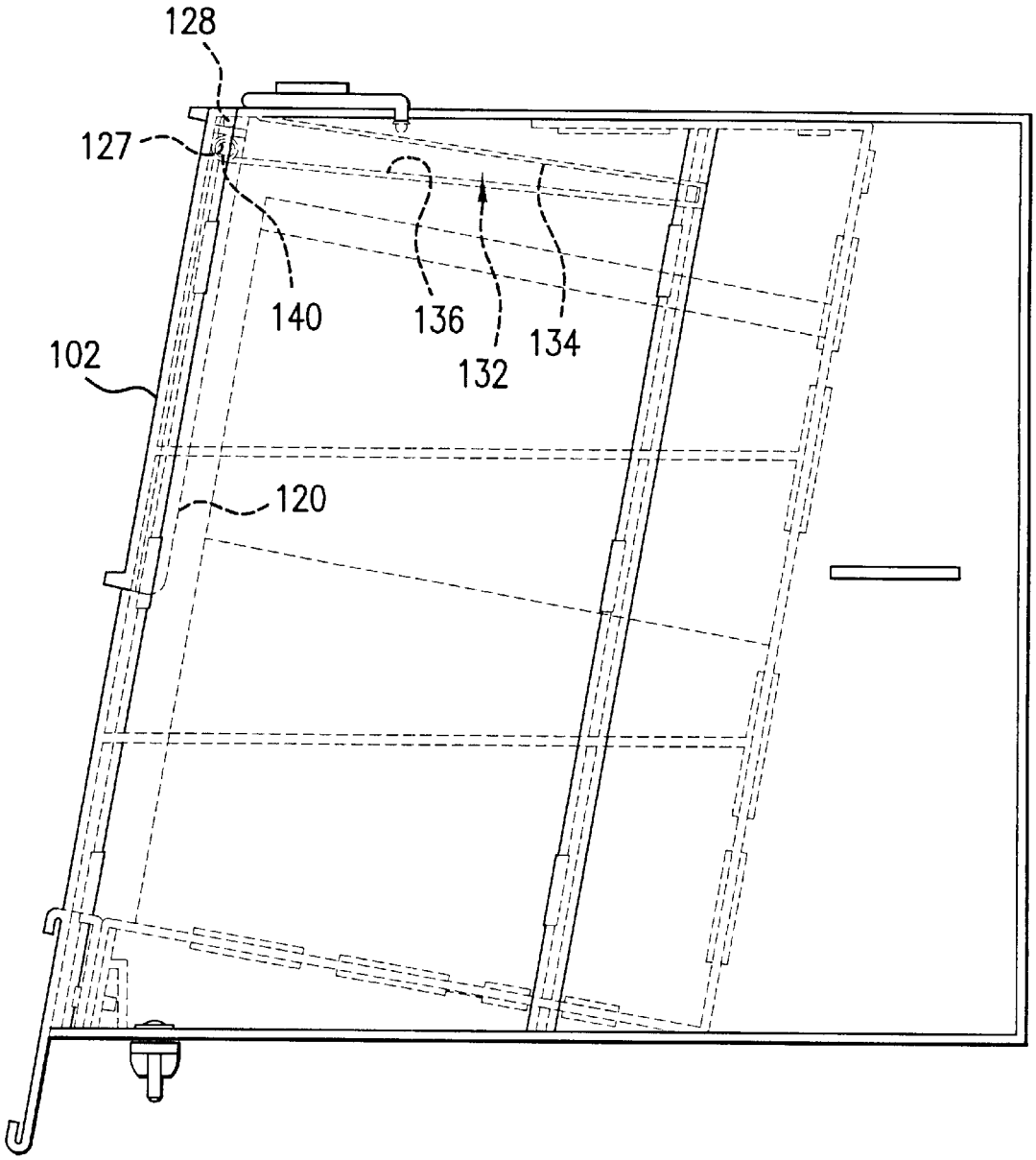
FIG. 8 is a right side view of the module of FIG. 2.

The illustrated signage carrier 34 further includes, along each of the left and right edges of the web 102, an associated track member 120 (e.g., formed of molded ABS). Each track member 120 has a front surface 122 (FIG. 8) secured to the rear surface of the web portion of the signage carrier extruded element (e.g., via ultrasonic weld or adhesive). Each track member also has surfaces defining a longitudinal slot 124 parallel to the surface 122 and extending between first and second ends or terminus 126 and 127. The slot extends nearly the entire length of the track member, and, thereby nearly the height of the signage carrier. At its upper end (when in the deployed position), each track member has a pair of coaxial opposed first axle shafts 128. The in board one of each pair of first shafts 128 is captured by the channel 114 with the outboard ones protruding out beyond the left and right edges 104 and 106. Each free outboard axle shaft 128 is captured within an associated channel 132 (FIG. 7) in the associated left or right side wall member. Each channel 132 is bounded by upper and lower guide surfaces 134 and 136, respectively. The guide surfaces are sloped slightly downward from front-to-back and also slightly converge from front-to-back. Each slot 124 in turn accommodates a second axle shaft 140. An end portion of each shaft 140 is captured in an associated circularly apertured boss 142 in the associated side wall (FIG. 3).

With the signage carrier in the deployed position (FIG. 8), each second shaft 140 is accommodated adjacent the upper terminus 127 of the associated slot 124. Each free outboard first shaft 128 is accommodated at an upper front extreme of the side wall channels 132. To stow the signage carrier, a user rotates the lower edge of the signage carrier upward about the axis of the shafts 140, which in turn rotates the first shafts 128 downward within the channels 132 and places the signage carrier in an intermediate position (not shown). The user then drives the signage carrier rearward with the first shafts 128 moving rearward in the channels 132 and the slots 124 moving rearward over the second shafts 140 until, in the stowed position of FIG. 4, the first shafts 128 are at the rear ends of the associated channels 132 and the shafts 140 are accommodated at the previously lower terminus 126 of the associated slots 124. An extraction and downward rotation would reverse this process.

Figure 5:
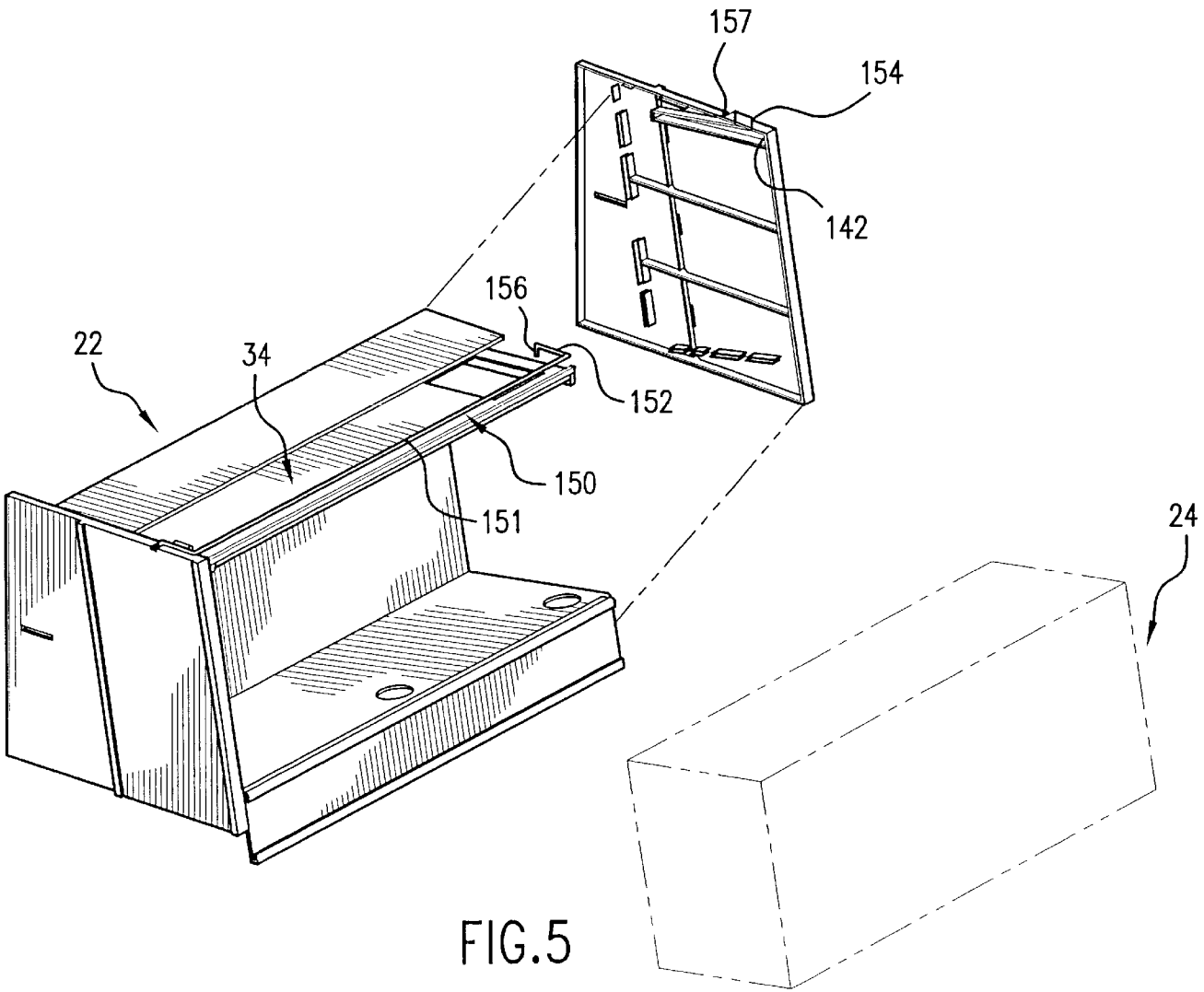
FIG. 5 is a perspective view of the partially exploded module of FIG. 4.
Figure 6:
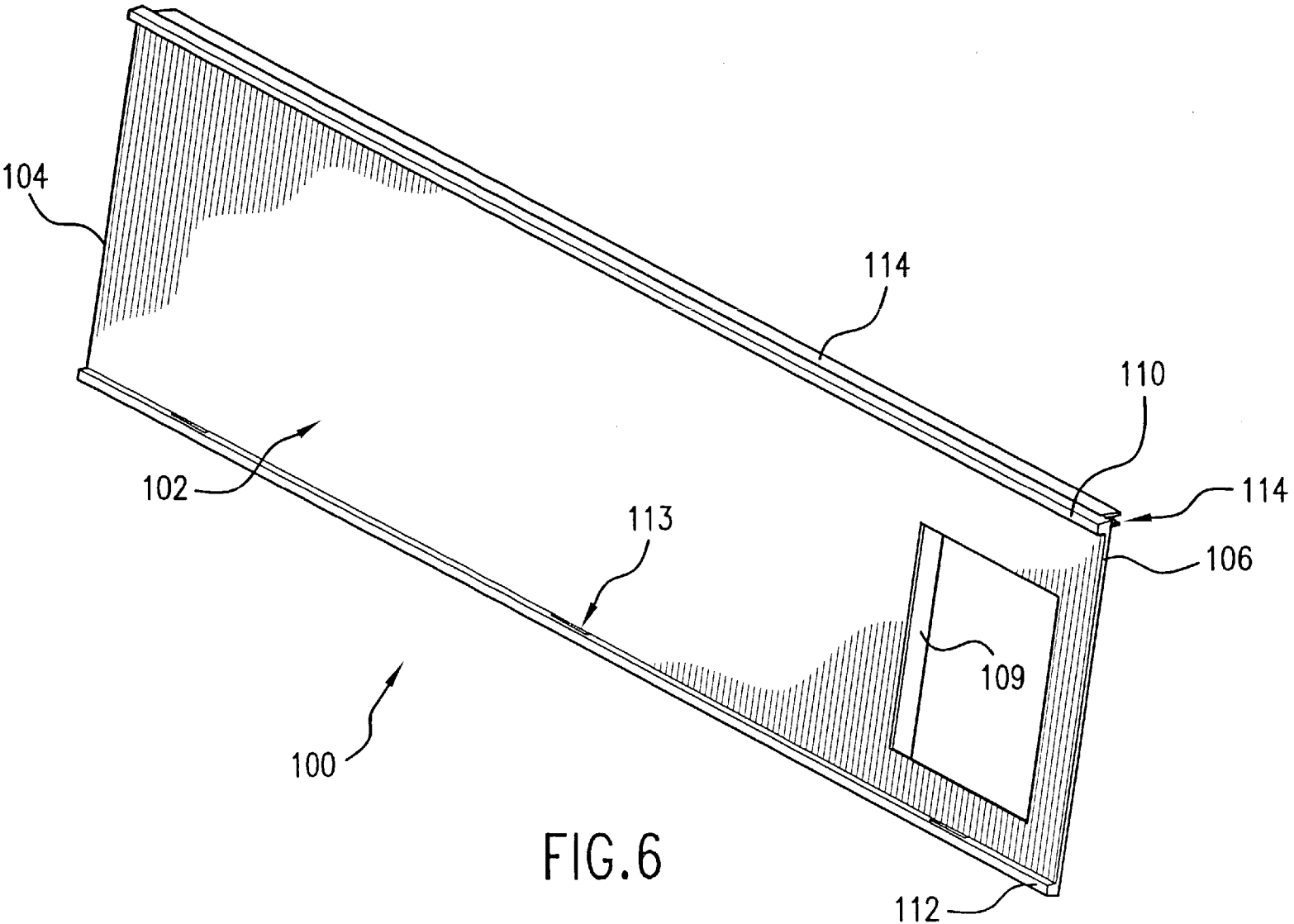
FIG. 6 is a view of an extruded component of the signage carrier of the module of FIG. 2.

A transverse wire brace 150 (FIG. 5) has a straight central portion 151 extending across the housing opening adjacent the upper end thereof. At left and right ends of the central portion, a portion 152 extends rearward along an upper end of the associated side wall and is partially captured beneath a catch 154 in the side wall (FIGS. 2 and 5). At the rear extremity of each portion 152, an end or terminal portion 156 (FIG. 4) extends downward through an aperture 157 in the associated side wall to capture and along with the catch 154 firmly retain the brace in place. The brace serves to prevent separation of the side walls from the first element 40, maintaining the edges of the first element 40 in the associated bosses 60 of the side walls. An open area between the brace and the first element 40 permits restocking of individual products, particularly by a consumer who removes the product from a bottom of a stack and decide not to purchase. The consumer can then drop the product through the open area to land atop the stack.

The exemplary signage holder 34 includes an aperture 160 (FIG. 2) shown, by way of example, spaced slightly inward from the right edge of the signage carrier web. When a signage card (if any) in the signage holder has a complementary aperture, the aperture 160 may serve to expose something there behind. By way of example, it may expose a pad of rebate forms, a brochure, or other literature. It may expose a product sample. There may be multiple such apertures with only a desired aperture or apertures or portion or portions thereof being exposed through the signage card. When there is no such pad, sample, or the like, the card may simply cover the aperture(s).

In the exemplary embodiment, each side wall includes a transverse slot 170 or other feature which may permit the mounting thereto of an accessory (e.g., a cup (not shown) for holding a pad of rebate forms or other literature). Also, each side wall includes a first rib 172 projecting outward along the front edge of the side wall and a parallel second rib 174 somewhat rearward thereof. Along facing edges of these two ribs (the rear edge of rib 172 and the front edge of rib 174), each includes a plurality of slots 176 for capturing tabs of a graphics card or the like to be held between the ribs.

Figure 9:
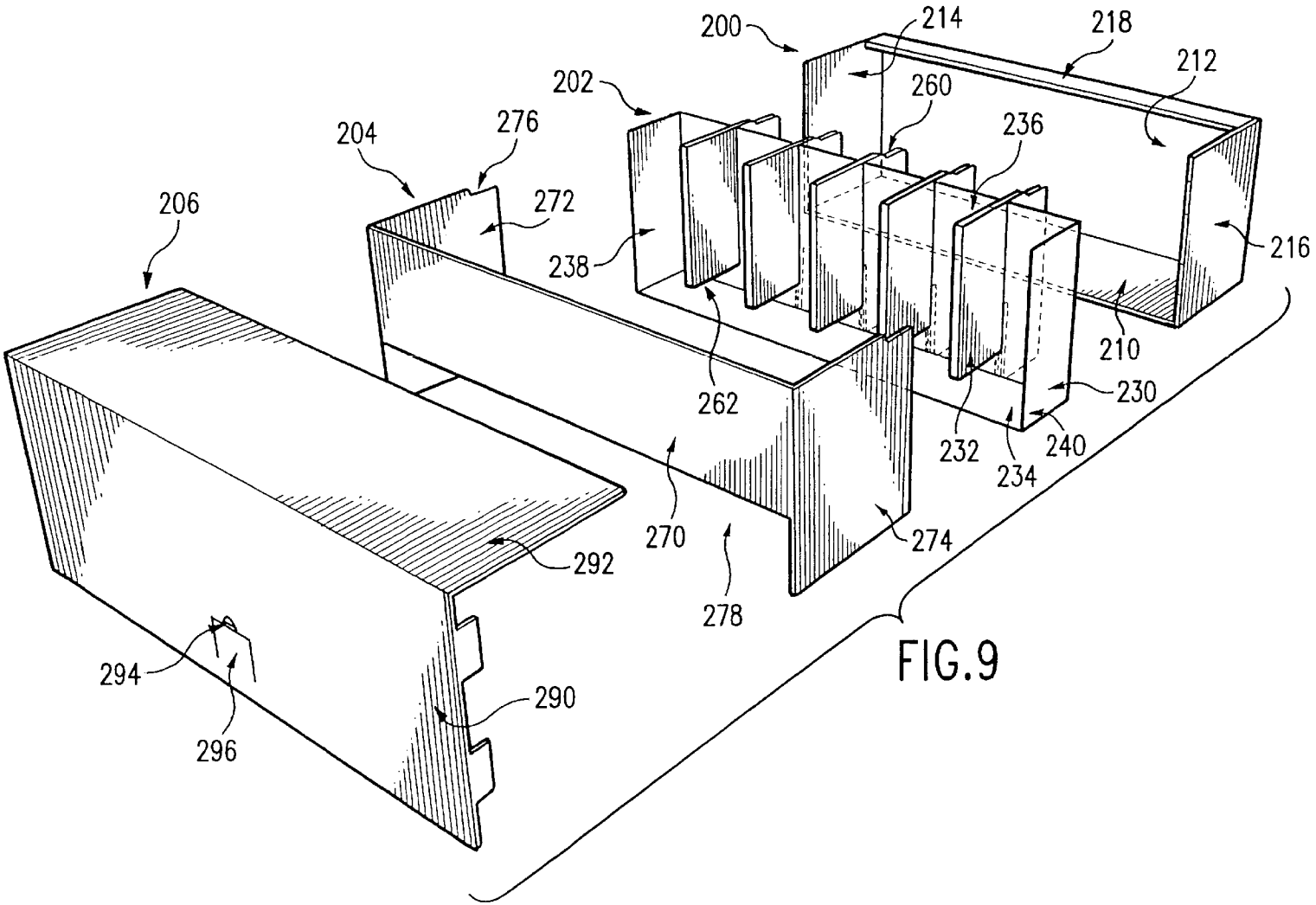
FIG. 9 is a partially exploded view of an empty product module.

FIG. 9 shows a product module including a body 200, a divider assembly 202, a product retainer 204, and a front cover 206. The front cover combines principally with the body to substantially completely contain product within the module during shipping. In an exemplary shipping system, one or two such modules are shipped in a single carton along with appropriate graphics and/or other accessories. The exemplary body 200 has rectangular bottom, back, left side, right side, and top walls 210, 212, 214, 216, and 218. These walls fall along the sides of a right parallelepiped to form a box-like structure with an open front. The bottom, back, and left and right side walls are coextensive with the corresponding facets of the parallelepiped, whereas the top wall extends only slightly forward of the top edge of the rear wall, having its front edge substantially recessed from the coplanar front edges of the bottom wall and side walls. This recess may permit consumer restocking through the open area along the housing top as described above.

Figure 10:
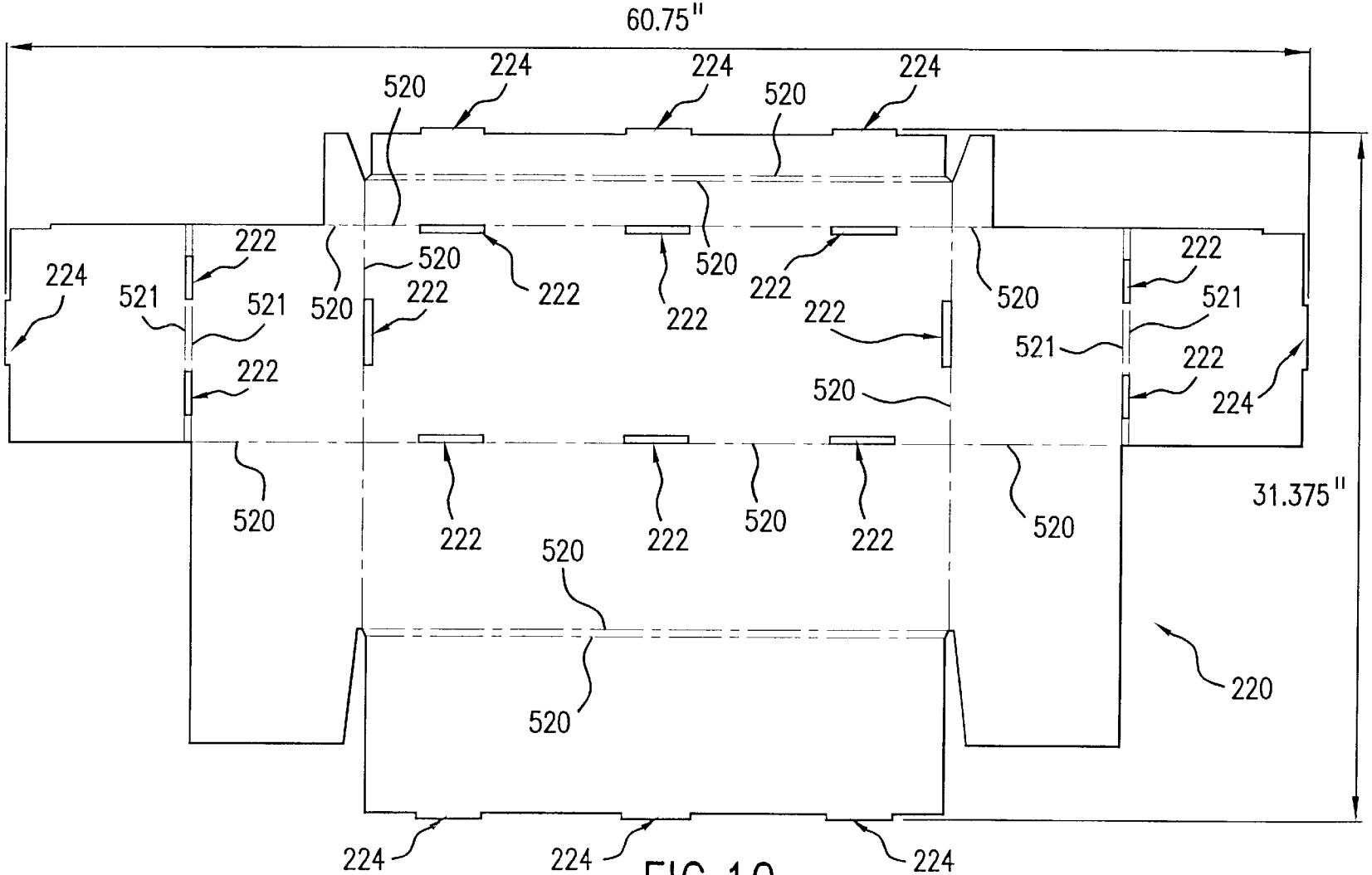
FIG. 10 is a plan view of a blank for forming a body portion of the module of FIG. 9.

FIG. 10 shows a blank 220 which may be folded to form the body 200. The blank is cut and formed with various pre-formed fold lines 520 and 521 (shown broken). In the exemplary embodiment, fold lines 520 are embossed depressions whereas fold lines 521 are through-scored. Cut lines (shown solid) define the blank with a number of apertures 222 and associated tabs 224 whose interactions permit the body to retain itself in its assembled condition when appropriately folded.

The divider assembly 202 (FIG. 9) includes a spacer 230 carrying a number of divider walls 232. The exemplary spacer has bottom, back, left side and right side walls 234, 236, 238, and 240. When installed in the body 200, the underside of the spacer bottom wall 234 lies flat atop the upper surface of the body bottom wall 210 and the spacer left and right side walls lie with their outer surfaces in close proximity or contact with the inner surfaces of the body left and right side walls. The front edges of the spacer and body side and bottom walls are approximately coplanar when so installed. The spacer back wall 236 will typically be spaced a substantial distance forward of the body back wall 212 so that each column or lane in the spacer has an appropriate depth to closely accommodate its associated product stack(s). A rearward shift of the assembly 202 is prevented by cooperation of rear edges of the divider walls 232 with the front surface of the body back wall 212.

Figure 11:
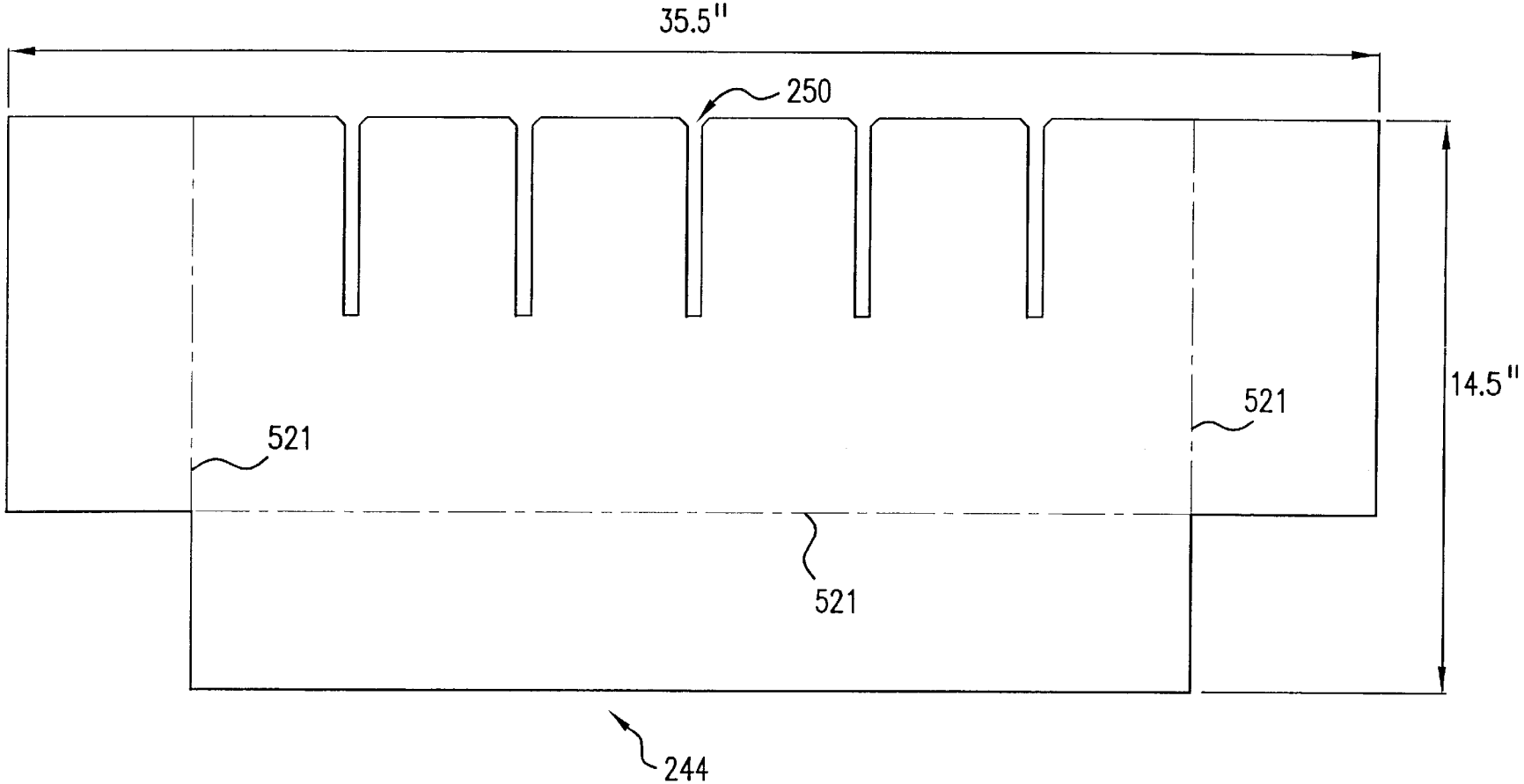
FIG. 11 is a plan view of a blank for forming a transverse divider of the module of FIG. 9.
Figure 12:
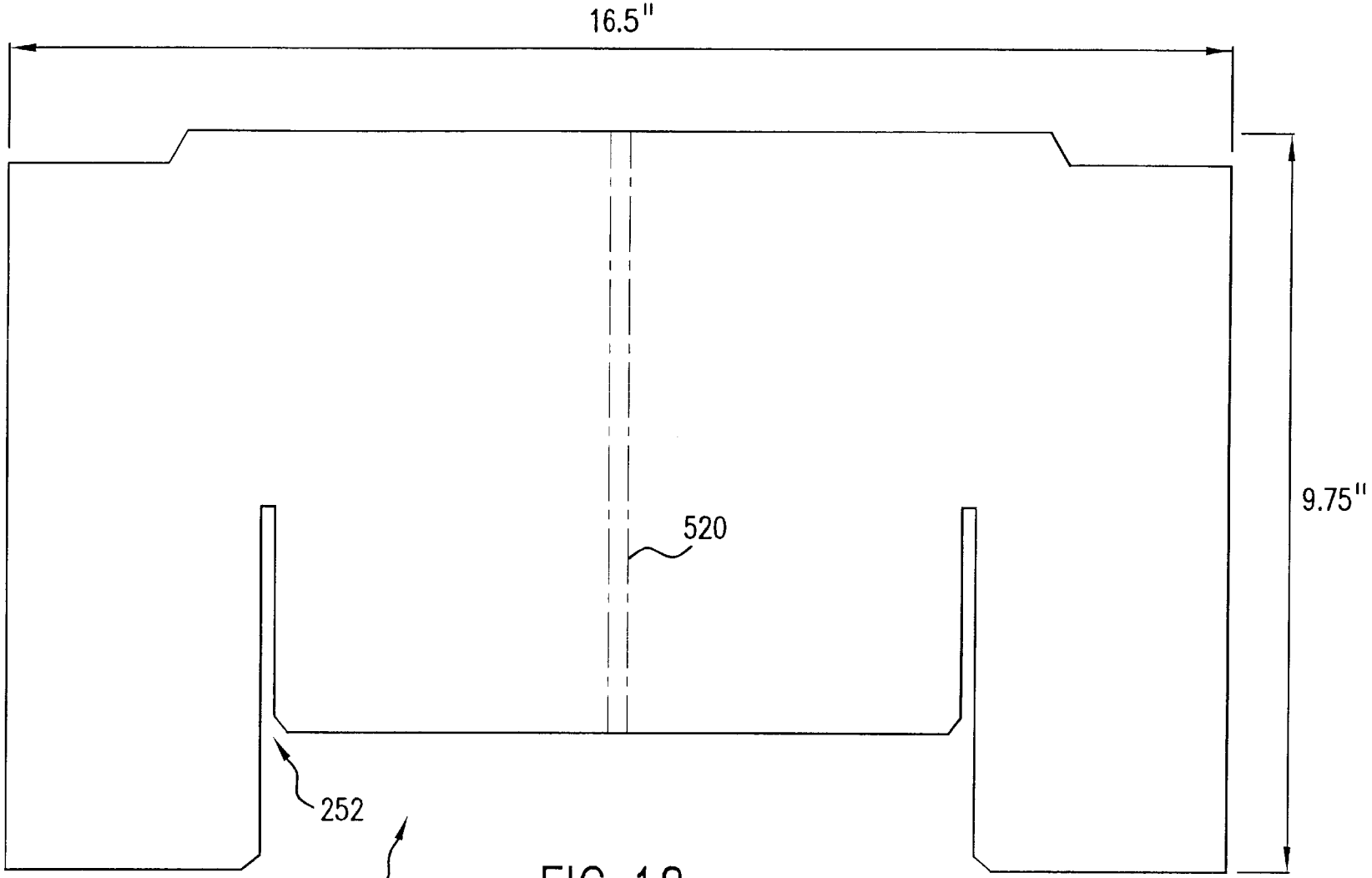
FIG. 12 is a plan view of a blank for forming one longitudinal divider wall for mounting on the transverse divider of FIG. 11.

FIGS. 11 and 12 respectively show spacer and divider wall blanks 244 and 246. The spacer blank 244 is provided with an array of slots 250 depending from the upper edge of the portion that forms the spacer back wall 236 for a distance of about half the height of that back wall. Each divider blank 246 is provided with two slots 252 so that when the blank is folded along a pair of fold lines 520, the blank becomes a wall with a small gap between its two layers and the slots 252 may capture the portion of the spacer back wall 236 immediately below an associated slot 250 just as the slot 250 captures portions of the two layers of divider wall immediately above the slots 252.

The upper edge of each divider wall is provided with a relieved or recessed area 260 (FIG. 9) extending forward from the rear edge by a sufficient distance and having a sufficient depth to receive the body top wall 218. Each divider bottom edge has a relieved or recessed area 262 extending rearward from the front edge. The recesses 262 define gaps between the dividers and the upper surface of the spacer bottom wall 234. The exemplary recesses 262 extend all the way to the divider wall slots so that the associated gap extends all the way back to the spacer back wall. The gaps have sufficient height and depth to allow a user's fingers to grasp the bottommost product in the adjacent stack(s). A portion of the divider's bottom edge to the rear of the spacer back wall 236 is advantageously coplanar with the underside of the spacer bottom wall 234.

The product retainer 204 has front, left side, and right side walls 270, 272, and 274. The product retainer is a particularly optional piece that serves to retain stacked product against falling forward. When assembled, the retainer side walls intervene between the spacer and body side walls and, accordingly, are provided with relieved or recessed areas 276 for receiving the body top wall. In this assembled condition, the back (interior) surface of the retainer front wall 270 abuts the front edges of the divider walls 232. The retainer front wall 270 advantageously has a bottom edge recessed substantially upward of the bottom edges of its side walls so as to define a transverse gap 278. The gap 278 permits the vertical extent of the front wall 270 to be hidden substantially entirely behind the signage carrier of the display module. The open area 278 may advantageously be somewhat higher than the recesses/gaps 262 for more fuller frontal exposure of the bottommost product in each stack while the dividers maintain stack separation.

Figure 13:
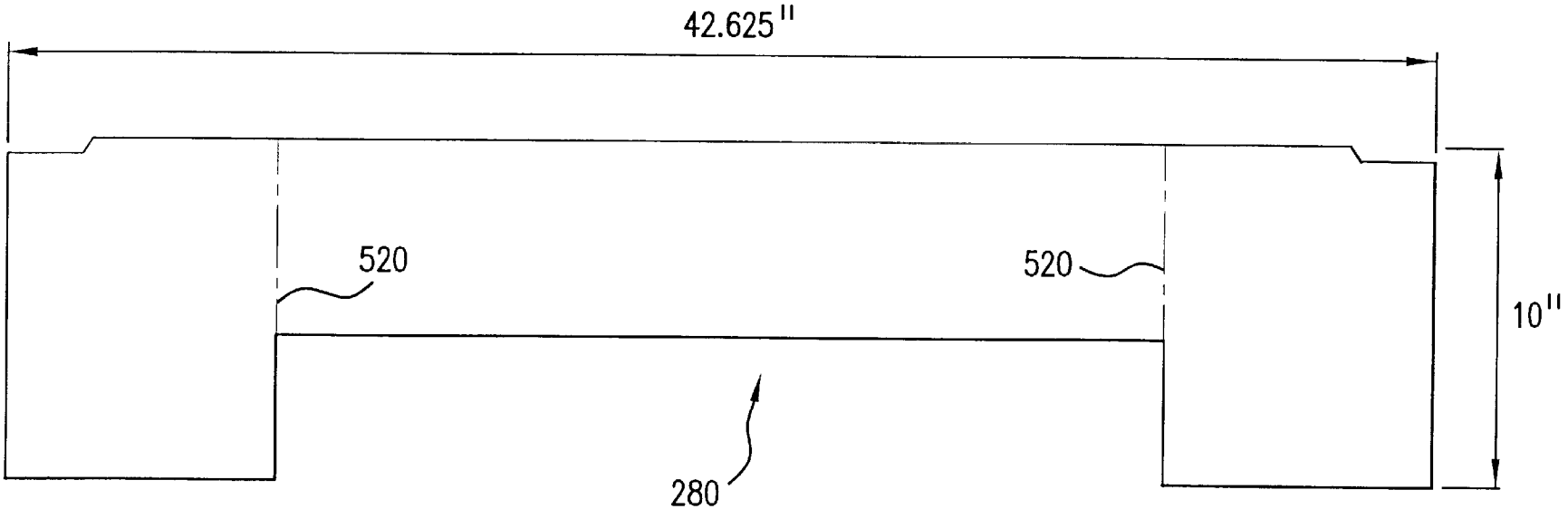
FIG. 13 is a plan view of a blank for forming a product retainer of the module of FIG. 9.

FIG. 13 shows a blank 280 for forming the retainer.

The cover 206 (FIG. 9) is advantageously provided for shipping and is disposable prior to or upon installation of a product module in the display module. The cover includes front and top walls 290 and 292. When installed, a rear edge portion of the cover top wall 292 may be sandwiched between the underside of the body top wall 218 and the relieved areas of the divider wall upper edges. A pair of tabs extending rearward from the left and right edges of the cover front wall 290 may be received in associated slots in the front edges of the body left and right walls 214 and 216. The cover front wall may be provided with a finger hole 294 and pull tab 296 allowing the cover to be easily removed from the rest of the product module prior to or upon installation.

Figure 14:
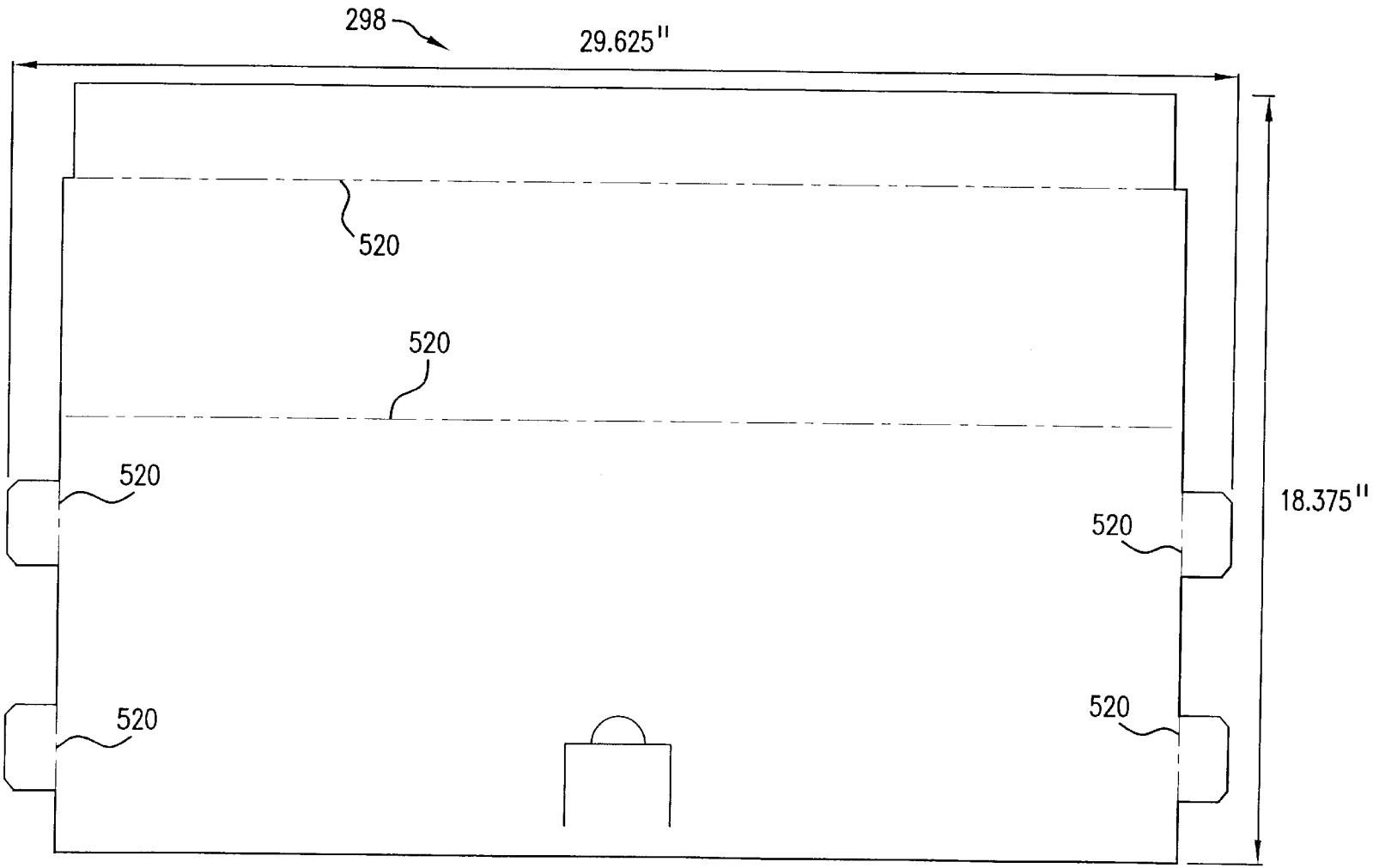
FIG. 14 is a plan view of a blank for forming a front cover of the module of FIG. 9.

FIG. 14 shows a blank 298 for forming the cover 206.

In one example of commercial use with a given product family or class, distinct product modules are provided for each distinct product. The various product modules may use key identically dimensioned components for efficiency. The front cover and body of each would likely be identical. Because the width and depth of the different products may differ, the properties of the divider assembly will typically vary accordingly. Variations would likely include the number of dividers and the offset provided by the spacer wall. The divider thickness could vary. Thus, the cross-section of the lanes can accommodate the cross-section of the stacks of products. The opening height of the retainer can vary based upon the height of the products.

In one example of commercial use, to initiate a first promotional event, kits for assembling the permanent or re-used display structure (basic unit) are sent to each participating store. Substantially simultaneously, one or more initial product modules are provided as are the relevant promotional graphic materials. The module(s) and the graphics may be packaged together such as in a single carton. Retail personnel may assemble the basic units and install the product modules and graphics. As the product sells down, an order is placed for a replacement product module filled with the required product. This is shipped to the store, whereupon the personnel need only open the front of the basic unit and replace the existing module with the new one. To initiate a subsequent merchandizing event using the same basic unit, a new product module containing the product associated with the subsequent event is similarly provided along with the graphics for such subsequent event. Thereafter, the modules may be replaced until the next event is initiated. The modules are advantageously disposable after the product is expended. The modules may include little or no graphics or other ornamentation and advantageously cost a small fraction of what a disposable corrugated display having similar ornamentation and functionalities to the entire system would have. Thus, although the fixed cost of the basic unit may well exceed the single cost of a highly ornate corrugated display, the savings incurred via reusing the basic unit should make up for this.

One or more embodiments of the present invention have been described. Nevertheless, it will be understood that various modifications may be made without departing from the spirit and scope of the invention. For example, the construction of the tray may be highly tailored to the nature of the product being displayed/dispensed. Alternate materials and construction techniques may well be used and details of the size, shape, and other feature of the basic unit may be tailored to the nature of the products being displayed/dispensed and the particular environment in which the unit is used. Accordingly, other embodiments are within the scope of the following claims.

What is claimed is:

1. A display device for placement on a shelf and dispensing product comprising:

a tray holding a plurality of products;

a housing having a front end opening for receiving the tray;

a signage carrier having an installed position mounted across a portion of the opening in front of an upper portion of the tray; and a signage carrying trim member, depending from the housing so as to be positioned in front of a front edge of the shelf.

2. The device of claim 1 wherein the housing comprises left and right side walls each having an outboard surface with:

a front portion shaped in elevation as a substantially non right parallelogram with horizontal bottom and top edges and front-to-back inclined fore and aft edges; and an aft portion having a substantially vertical aft edge.

3. The device of claim 1 wherein the signage carrier has an aperture for exposing a product sample mounted to the tray.

4. The device of claim 3 wherein the products comprise over the counter medications.

5. The device of claim 1 wherein the tray includes:

a front wall having sufficient open area to provide access to a bottom one in each of a plurality of stacks of the product; and divider walls between adjacent stacks.

6. The device of claim 5 wherein the divider walls are formed having a layer proximate each adjacent lane and separated by a gap substantially larger than a layer thickness to space apart the products in the respective lanes and the divider walls, along forward extremities thereof have gaps effective to allow grasping of the bottom product in the stacks.

7. The device of claim 6 wherein:

the housing has a floor oriented at a substantially right angle to the front edges of the housing wall front portions so that the stacks are slightly declined; and the tray is formed as a right corrugated boxboard structure having a bottom wall dimensioned to fit flat atop the housing floor when installed so as to recline the product stacks.

8. The device of claim 1 wherein the signage carrier comprises:

a central web;

left and right portions each having an elongate slot capturing a first pivot means of the housing; and a second pivot means captured by the housing.

9. The device of claim 8 wherein:

the signage carrier is shiftable between said installed position and a stowed position by means of initial rotation about the first pivot means followed by an insertion, which insertion moves the elongate slots along the first pivot means and moves the second pivot means rearward within the housing.

10. The device of claim 1 wherein a wire brace extends across an upper portion of the opening.

11. The device of claim 1 wherein the trim member comprises a coextrusion of a relatively rigid plastic and a relatively flexible plastic, the relatively flexible plastic providing a hinge between two sections of the relatively rigid plastic.

12. A tray assembly comprising:

a plurality of stacks of products;

a body formed of a folded corrugated material and having:

a bottom wall with front and back edges and left and right edges;

a back wall extending upward from the bottom wall back edge and having bottom and top edges and left and right edges;

left and right side walls extending upward from the bottom wall left and right edges; and a top wall; and a divider assembly, comprising:

a plurality of front to back divider walls separating a plurality of lanes, each lane carrying an associated one of the stacks; and a spacer wall carrying the plurality of divider walls, the spacer wall having a forward surface forwardly offset from a forward surface of the body back wall;

wherein:

the body has an open front area of sufficient extent to provide access to a bottom product in each such stack.

13. The tray assembly of claim 12 wherein:

the plurality of divider walls each have open areas dimensioned to allow a user to insert one or more fingers between the stacks to grasp the bottom products; and a retainer covers a portion of a front of the body above the open front area.

14. A tray assembly comprising:

a body formed of a folded corrugated material and having bottom, back, top and loft and right side walls along portions of associated surfaces of a right parallelepiped, and having an open area along at least a lower portion of a front of the parallelepiped;

a divider carried within the body and comprising:

a plurality of front-to-back divider walls having separation effective to define a plurality of lanes;

a spacer wall having a forward surface forwardly offset from a forward surface of the body back wall.

15. The tray assembly of claim 14 wherein:

the body consists essentially of a single piece of corrugated boxboard, the spacer wall is so offset by a distance between 25% and 75% of a depth of the body;

said body open area extends over the entire front the parallelepiped above the bottom wall; and the body has a second open area along at least a front portion of a top of the parallelepiped.

16. The tray assembly of claim 15 wherein:

the second open area extends over at least half of the top of the parallelepiped; and the divider comprises an assembly of corrugated boxboard pieces:

a first piece providing said spacer wall and having left and right side portions folded back at left and right edges of the spacer wall and extending along rear portions of the left and right side walls to maintain the offset of the spacer wall from the back wall; and a plurality of divider pieces each forming one of the divider walls, the divider walls being of two layer construction over at least a major portion thereof.

17. The tray assembly of claim 16 wherein:

the divider walls and the first piece left and right portions each have relieved areas accommodating the body top wall;

each divider wall has a gap above the bottom wall at a front portion of the divider wall; and each divider wall has a slot receiving a portion of the spacer wall and the spacer wall included a plurality of slots, each receiving a portion of an associated one of the divider walls;

wherein the body has a second open area along at least a front portion of a top of the parallelepiped.

18. The tray assembly of claim 15 further comprising:

a plurality of stacks of products, each stack within an associated one of the lanes; and a removable corrugated material cover covering the body open area and second open area.

19. The tray assembly of claim 18 further comprising:

a retainer having:

a front wall covering a portion of the body open area above a lower portion of the body open area; and left and right side walls sandwiched between the respective left and right side walls of the body and the left and right side portions of the divider first piece.

20. The tray assembly of claim 19 wherein:

the cover consists essentially of a single piece of corrugated boxboard;

the cover includes means for defining a pull tab;

the cover includes tabs extending into apertures along fold areas along the front edges of the body side walls; and the cover includes a portion wedged between the body top and the divider walls.

21. The tray assembly of claim 15 wherein:

the body has a single layer along its back wall; and the body has at least two layers along each of its top wall, bottom wall, and left and right side walls, with a fold area along the front edge of the top wall, bottom wall, and left and right side walls and an inner of two layers of each of the left and right side walls having at least one tab extending into an associated aperture in the back wall.

22. The tray assembly of claim 12 wherein the top wall of the body extends only slightly forward of the top edge of the rear wall so as to permit restocking of the product in each stack without disassembly of the tray assembly.

23. The tray assembly of claim 12 wherein each of the plurality of divider walls includes an upper edge, and the upper edge of each divider wall includes a recessed area of sufficient depth to receive the top wall of the body.

* * * * *